United States Patent [19]

Mackie

[11] 4,046,125

[45] Sept. 6, 1977

[54] CAPACITIVE DISCHARGE IGNITION SYSTEM

[76] Inventor: Ronald D. Mackie, 5500 Sea Spray Drive, Pensacola, Fla. 32507

[21] Appl. No.: 623,225

[22] Filed: Oct. 17, 1975

[51] Int. Cl.[2] ..... F22B 7/00

[52] U.S. Cl. ..... 123/148 E; 123/148 CC

[58] Field of Search ..... 123/177 R, 146.5 A, 123/148 E, 148 OCD, 148 KD, 148 MCD

[56] References Cited

U.S. PATENT DOCUMENTS

| | | | |
|---|---|---|---|
| 3,342,167 | 9/1967 | Tarter | 123/148 E |
| 3,372,681 | 3/1968 | Phillips et al. | 123/148 KP |
| 3,465,738 | 9/1969 | Geritch et al. | 123/148 OC |
| 3,504,373 | 3/1970 | Strelow | 123/148 E |
| 3,560,833 | 2/1971 | Orsai et al. | 123/148 OC |
| 3,800,771 | 4/1974 | Mackie | 123/148 OCD |
| 3,893,438 | 7/1975 | Diener | 123/148 E |

FOREIGN PATENT DOCUMENTS

| | | | |
|---|---|---|---|
| 1,916,091 | 10/1970 | Germany | 123/148 OCD |
| 2,057,520 | 9/1971 | Germany | 123/148 OCD |

*Primary Examiner*—Carroll B. Dority, Jr.
*Assistant Examiner*—Paul Devinsky
*Attorney, Agent, or Firm*—Beveridge, DeGrandi, Kline & Lunsford

[57] ABSTRACT

A high efficiency capacitive discharge ignition system utilizing the principle of simultaneous energy storage on both a capacitor and an inductor during the time that energy is drawn from the vehicle battery. The system is adapted for use with a breakerless type distributor by providing transistor switching circuitry which opens and closes a circuit on the primary side of a transformer in accordance with the output pulse of the distributor.

14 Claims, 2 Drawing Figures

CAPACITIVE DISCHARGE IGNITION SYSTEM

Figure 1:
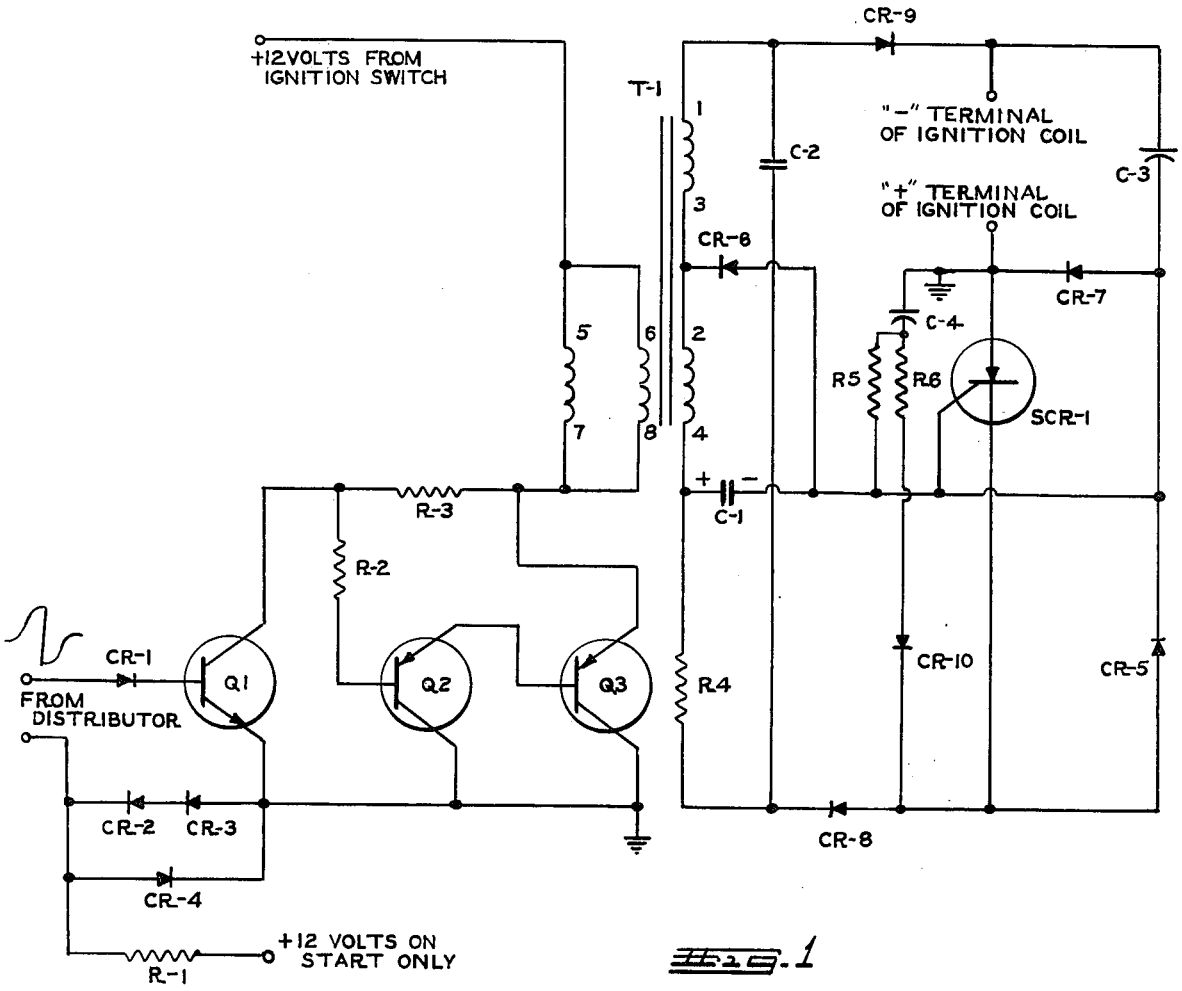

The present invention relates to an improved capacitive discharge ignition system for internal combustion engines.

The invention is an improvement on the capacitive discharge ignition system disclosed in U.S. Pat. No. 3,800,771, invented by Ronald D. Mackie. In that patent the principle of a capacitive discharge ignition system which uses simultaneous energy storage on both a capacitor and an inductor during the time that energy is drawn from the vehicle battery is disclosed. Utilizing both capacitive and inductive energy storage, during the time energy is being drawn from the battery, instead of only one or the other as done in the prior art, increases the amount of useable energy obtainable relative to the total energy used, thereby increasing the efficiency of the ignition system.

The ignition system disclosed in U.S. Pat. No. 3,800,771 is a points operated system. However, during the last few years magnetic breakerless type distributors have supplanted points type distributors in automotive vehicles to a significant extent. During the same period of time it has become more important than ever for automotive vehicles to operate as efficiently as possible.

The present invention therefore has two aspects. Firstly it extends the application of an ignition system using the simultaneous energy principle to breakerless distributor operation and it does this in a unique way. Secondly, several circuit changes are made in the basic ignition system disclosed in U.S. Pat. No. 3,800,771 to improve the efficiency and overall operation thereof. It should be understood that the circuit improvements are applicable to the points type system as well as the breakerless distributor embodiment.

It is therefore an object of the invention to adapt a capacitive discharge ignition system utilizing simultaneous energy storage on a capacitor and an inductor for operation with magnetic distributors of the breakerless type.

It is a further object of the invention to improve the efficiency and reduce the cost of manufacture of the capacitive discharge ignition system disclosed in U.S. Pat. No. 3,800,771.

It is still a further object of the invention to improve the SCR false triggering characteristic of the circuit disclosed in U.S. Pat. No. 3,800,771.

It is still a further object of the invention to provide a capacitive discharge ignition system which will provide high amplitude sparks even with a very low battery assuming that the engine can be made to turn over.

It is a further object of the invention to provide a capacitive discharge ignition system having a low current drain, and which permits the accessory position on the ignition switch to be dispensed with.

It is a further object of the invention to provide a capacitive discharge ignition system which automatically provides a relatively high output voltage, long spark duration and a low dwell at starting and low engine speeds, and a relatively lower output voltage, shorter spark duration and higher dwell at higher engine speeds.

The invention will be better understood by referring to FIG. 1 which illustrates an embodiment thereof.

Figure 2:
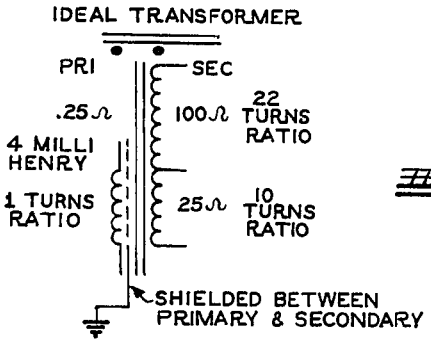

FIG. 2 is a schematic representation of an ideal transformer which may be used in the circuit of the invention.

For a complete understanding of the circuit disclosed in U.S. Pat. No. 3,800,771, the reader is referred to that patent which is incorporated herein by reference. As indicated above the circuit improvements of the present invention (those on the secondary side of the transformer) are applicable to points as well as breakerless operation. In both cases the primary circuit of transformer T-1 is periodically closed and opened resulting in rising and falling currents respectively in the primary winding (or windings), which rising and falling currents induce voltages of opposite polarities in the secondary winding of the transformer. While an off the shelf transformer having an equally split secondary, such as the Stancor P-6375 is suitable for T-1, for optimum operation the ideal transformer shown in FIG. 2 may be used.

Referring to the drawing, capacitor C-3 is the discharge capacitor which discharges through the SCR and ignition coil when the SCR is triggered on. The use of simultaneous capacitive and inductive storage mechanisms cause the present system to pass through the maximum rate of usable energy transfer point twice instead of only once during the energy is being drawn from the battery. Referring to the drawing, energy stored inductively in the transformer during Q-3 conduction is transferred during Q-3 non-conduction by the secondary of the transformer and stored capacitively on storage capacitor C-1 to be transferred to discharge capacitor C-3 along with direct capacitive transfer of energy during the next Q-3 conduction to build up the charge on the discharge capacitor to a greater level than if only either inductive or capacitive energy transfer were used. The only time that energy can be drawn from the battery is during Q-3 conduction.

When the primary circuit is opened a voltage is induced in the secondary having a polarity such that the bottom of the transformer in the drawing is positive with respect to the top. This secondary voltage increases the energy on storage capacitor C-1. The average voltage on C-1 as well as the inductive value of the lower half of the transformer secondary are determined so that the capacitor is fully charged before the primary circuit is closed. When the primary circuit is closed a voltage is induced in the secondary having a polarity such that the top of the secondary in the drawing is positive in respect to the bottom. This voltage is applied to discharge capacitor C-3 along with the voltage across storage capacitor C-1 to charge capacitor C-3. According to an improvement introduced in the present circuit the capacitance of storage capacitor C-1 is greatly increased over that utilized in U.S. Pat No. 3,800,771 while the operating voltage thereof has been lowered. This has the effect of increasing the operating efficiency, decreasing the working voltages, and reducing the cost of the circuit. The maximum capacitance value of C-1 is decided when the number of Q-3 on-off cycles required to reach C-1's average charge potential causes the engine initial cranking time to be excessively long. When utilized with the other component values listed at the end of the specification it was found that a capacitor of 16 microfarads did not take an excessively long time to charge. Besides the advantages listed above increasing the size of the storage capacitor also results in a smaller variation in successive spark voltages than could occur with the smaller capacitor if optimum dwell was not maintained.

Discharge capacitor C-3 is now charged and shortly after the primary circuit is opened again the gate-emitter junction of the SCR becomes forward biased, the SCR is triggered on, and the charge stored on discharge capacitor C-3 discharges through the SCR and the ignition coil, causing a spark plug of the vehicle to fire.

According to a further improvement of the present circuit the trigger developing resistor (R-1 in U.S. Pat. No. 3,800,711) has been eliminated so that a minimum amount of power is consumed in triggering the SCR, resulting in more efficient operation. As can be seen, in the present circuit the trigger path is through a very small and inexpensive (0.005 MFD) capacitor so that minimal energy is wasted in developing a trigger signal. A large value (100k) resistor R-4 is utilized simply to allow slow voltage changes on capacitor C-2 following the triggering of the SCR. Capacitor C-2 is charged through resistor R-4 shortly after the SCR triggers until it reaches a potential greater than on capacitor C-1. The further charging of capacitor C-2 through R-4 causes the CR-8 to become back biased. Diode CR-8 is back biased by the voltage always present across capacitor C-1, which significantly reduces the possibility of false triggering the SCR at any time other than at trigger time, i.e. when transistor Q-3 cuts off. However, the circuit positions of C-2 and CR-8 can be interchanged, if increased trigger sensitivity is required.

As indicated above, when the SCR is triggered, discharge capacitor C-3 discharges therethrough. A further improvement of the present circuit is to connect capacitor C-3 across the anode (actually through the ignition coil) and the gate of the SCR instead of across the anode and cathode. Additionally one side of capacitor C-3 is connected directly to one side of capacitor C-1. These modifications improve the firing stability of the SCR and prevent false triggering thereof by transients which may occur during the charging of capacitor C-3. Since the gate of the SCR is capable of only passing a small portion of the total conduction current, diode CR-5 is utilized to provide a return path for the larger portion of the current which flows through the cathode.

Further, C-4, R-5, R-6 and CR-10 prevent multiple firing (long spark durations) of the SCR. This is particularly advantageous for racing applications or when extra wide spark plug gaps are used. While the circuitry reduces the spark durations to one firing of the SCR, the energy saved is returned to the discharge capacitor and is used to provide the extra high output voltages required for wide plug gaps and racing conditions.

As CR-7 stops conducting there is a rapid rise in positive voltage at the anode of the SCR which would serve to re-fire the SCR for extended spark durations if circuitry C-4, R-5, R-6 and CR-10 were not provided. CR-10 passes this positive rise to the cathode of the SCR, forward biasing CR-5 and back biasing the cathode-gate junction, which prevents re-firing. R-5 provides a discharge path for C-4. False triggering is also reduced because at any time that there is a positive swing at the anode of the SCR the gate-cathode junction is back biased. This also occurs at any time a charge is being placed on C-3, when CR-9 is forward biased and false triggering from the anode side of the SCR is most likely to occur.

For passenger vehicle operation as opposed to racing operation long spark durations are ordinarily desirable and therefore the circuitry consisting of C-4, R-5, R-6 and CR-10 may be dispensed with.

If intermediate spark durations are desired, the circuitry may be provided and R-5 may be increased in resistance. Increasing the resistance of R-5 slightly will increase the spark duration at the low RPM end and increasing it further will increase the duration at higher RPM's.

As discussed above, a further object of the present invention is to uniquely adapt a points type capacitive discharge ignition system utilizing simultaneous capacitive and inductive energy transfer, to operate with distributors of the breakerless type which have come into widespread use in the last few years. As known to those skilled in the art, the basic breakerless distributor is comprised of a rotating armature or reluctor having a plurality of spokes protruding therefrom at the periphery and which pass a stationarily disposed permanent magnet as they rotate. As each spoke approaches the magnet a pulse of a given polarity is generated in a pickup coil and as the spoke is moved away from the magnet a pulse of opposite polarity is generated. Thus, referring to the drawing one spoke of the armature passing towards and away from the permanent magnet generates the pulse waveform shown at the left side of the Figure. As the speed of rotation of the armature decreases the peak to peak voltage of the waveform also decreases while the duration increases and the leading and trailing edges become less steep. Conversely, when the speed of rotation increases the peak to peak voltage increases while the pulses become narrower and the leading and trailing edges become steeper. Typically, the breakerless distributor peak to peak voltage may range from 2 to 4 volts at starting and from 20 to 40 volts at higher engine speeds.

Referring to the transformer primary circuit in the drawing, the purpose of the transistor circuit is to close and open the primary winding circuit in accordance with the distributor output pulses. When the transistors are switched on by the positive portion of each pulse, current from the battery flows through the primary winding and through power transistor Q-3. At the end of the positive pulse portion the transistors are turned off and the current stops flowing, the magnitude of the primary winding current being dependent upon the amount of time that the transistors were switched on. Diodes CR-1, CR-2, and CR-3 block the negative wing of the pulse from damaging the base-emitter junction of transistor Q-1. Additionally, the diodes prevent the transistors from triggering until the pulse has reached a first predetermined minimum amplitude. In the illustrative embodiment of the invention this amplitude is selected to be 2.4 volts and the diodes are selected to each have a forward short circuit voltage of 0.6 volts. Further, the transistors are selected to have a forward base-emitter short circuit voltage of 0.6 volts so that the transistors will not conduct until the input waveform has exceeded 2.4 volts. If desired, diode CR-3 may be eliminated at the cost of greater battery drain at the low RPM end but such a change does increase trigger sensitivity and provides a little more output energy.

Blocking the low amplitude part of the signal from the transistors results in faster saturation turn-on of the transistors, resulting in less heat dissipation and power waste in the transistors themselves and in turn-off of transistor Q-3 at low engine speeds at just about the same time that the primary of transformer T-1 saturates. Conduction of transistor Q-3 after the primary of transformer T-1 had saturated would result in inefficient operation due to the power wasted in heating the primary winding of the transformer and the high current heating of the transistors, mainly transistor Q-3.

The faster saturation turn-on of the transistors results from the faster rate of voltage increase of the input waveform above 2.4 volts. This is particularly important when the input waveform becomes greater in amplitude with the leading edge becoming steeper. Due to the three diodes the conduction time for transistor Q-3 at very low rpm is held down to only about 5 milliseconds duration (equivalent to a point dwell of approximately only 15 percent), but is still allowed to conduct for as long as one millisecond at approximately 50 percent at this high 8 cylinder engine rpm). The on time of transistor Q-3 is thereby automatically regulated to produce the best output voltage, that is highest for starting and idling where high output is required and decreasing with increased engine rpm as spark requirements becomes less. A relatively low dwell results at low rpm as is desired and a higher dwell results at higher rpm as is desired. The output voltage always remains at a more than adequate level while at the same time drawing less than normal amperage from the battery.

The circuit is further arranged so that a voltage at a second predetermined amplitude substantially lower than said first predetermined amplitude is effective to turn transistor Q-3 on at engine start. In the illustrative embodiment this second amplitude is selected to be 0.6 volts as opposed to 2.4 volts, which is the first amplitude. Resistor R-1 and diode CR-4 are connected to the battery voltage through the start switch so that the battery voltage is applied only at start. This is effective to increase the input sensitivity of transistor Q-1 by the desired amount. This is important during cold weather or low battery conditions when the amplitude of the output signal of the magnetic distributor is relatively low due to the slow starting rpm's which can be experienced under these conditions. However, if the distributor is designed so that sufficient amplitude trigger voltage is maintained during starting or if it provides sufficient amplitude trigger voltage during starting it is not necessary to apply the battery voltage and resistor R-1 and diode CR-4 may be dispensed with.

Resistor R-3 helps to insure positive turnoff of transistors Q-2 and Q-3 and resistor R-2 prevents damaging current levels from being reached in the base-emitter junctions of transistors Q-2 and Q-3 should the SCR fire prematurely during the conduction phase of transistors Q-1, Q-2 and Q-3 or should transformer T-1 oversaturate for some reason.

As indicated above, the discharge circuit is arranged so that at high voltages of discharge capacitor C-3, the SCR retriggers itself several times. Now it is seen that the higher voltages occur at lower engine speeds where the re-triggering and longer spark durations are needed. Additionally, the present ignition system will put out extremely high amplitude sparks even with a practically dead battery by building up stored energy to the point where the weak trigger resulting at very low battery voltage is sufficient after the voltage across the SCR has been built to a high level. Some sparks will be skipped in the process but if the remaining sparks can get the engine turning fast enough so that the generator or alternator will start producing, the engine can be made to run, providing that there is some way to get it turning over in the first place.

An additional advantage of the present circuit is that when the engine is not turning no current at all flows except for the transistor leakage current, which is generally in the neighborhood of only 1 to 50 microamperes. This low on position current allows elimination of the accessory position normally found on ignition switches. Additionally the short turn-on period of transistor Q-3 even at low engine speeds permits the ballast resistor required by point actuated systems to be eliminated, resulting in greater efficiency.

Illustrative component values and identifications for the circuit of the invention are listed below. These values are typical but may be varied while remaining within the scope of the invention:

| | |
|---|---|
| R-1 1500 ohms | CR-1 to CR-10 silicon diodes |
| R-2 56 ohms | T-1 Stancor P - 6375 |
| R-3 1000 ohms | Q-1 ECG-128 or 2N3053 (preferred) or 2N3300 |
| R-4 100k ohms | |
| R-5 1000 ohms | Q-2 ECG-129 or 2N4037 or 2N4036 or 2N5323 (preferred) |
| R-6 10,000 ohms | |
| C-1 16 MFD at 450 WVDC | Q-3 T1P34A, B or C |
| C-2 .005 MFD | SCR-1 T16-116E or T16-116M |
| C-3 1 MFD at 600 WVDC | |
| C-4 .005 MFD | |

A summary of the performance possible from this type of ignition system is as follows:

1. Practically zero current drain on the electrical system, when the engine is not turning, even though the ignition is left on.

2. A one cylinder four cycle engine can be operated at 3600 rpm with over 400 volts applied to the primary of the spark coil, of sufficient energy to allow a half millisecond duration spark with only one tenth of an ampere drain on a 12 volt source.

3. Output voltages of 500 to 600 volts in amplitude and over 1 millisecond in duration, while draining less than 1 ampere from a 12 volt source are easily obtainable at low rpm on an eight cylinder engine. Output voltages of approximately 400 volts in amplitude and one third millisecond duration while drawing less than 4 amperes are possible at 10,000 rpm.

4. All of the preceding performance parameters represent significant energy savings, by tremendously reducing the current draw from a 12 volt source of energy.

Since all of this energy must ultimately come from the burning of some type of fuel, a large scale use of such an ignition system would result in a substantial saving of fuel, which is presently becoming more difficult to supply.

5. Spark plug life without regapping or cleaning has been extended at least five times, and possibly over 10 times, that possible with less powerful ignition systems.

Additionally, the transformer T-1 can be improved by moving the tap on the secondary downward until the turns in the lower half comprise one fourth to one third of the total secondary turns. The DC resistance of the lower half of the secondary should be reduced to about 25 ohms. The upper portion of the secondary should be about 100 ohms.

The primary should be about 4 millihenry with one fourth of an ohm DC resistance.

The core should not saturate before 10 amperes of primary current is reached.

The primary to overall secondary turns ratio should be about 1 to 32.

A transformer such as previously described would provide the following advantages over the Stancor P6375.

1. More efficient operation and higher output at spark intervals in the range of 1.5 milliseconds.

2. Reduced voltage spike amplitude across transistors Q-1, Q-2 and Q-3 when they turn off.

3. Greater back biasing of the charging diode CR-9, during the time C-3 is discharging energy into the spark coil, preventing any energy from C-3 returning to C-1.

4. More trigger voltage to the SCR for improved cold weather or slow cranking starting capability.

While I have disclosed and described an embodiment of my invention, I wish it to be understood that I do not intend to be restricted solely thereto, but that I do intend to cover all embodiments thereof which would be apparent to one skilled in the art and which come within the spirit and scope of my invention.

I claim:

1. A breakerless capacitive discharge ignition system, comprising, a breakerless distributor including a rotating member and a pickup coil which has voltage pulses induced therein as said member rotates, each of said induced voltage pulses having a positive and negative excursion, a step-up transformer having a primary winding and a secondary winding, a primary circuit comprising said primary winding, a battery and a switch means, a discharge capacitor, a silicon controlled rectifier and an ignition coil being connected in circuit relationship with each other, with said discharge capacitor, and with the secondary winding of said transformer, means for applying the voltage induced across said secondary winding of said transformer when said primary circuit closes to said discharge capacitor to charge it, means for discharging said discharge capacitor through said silicon controlled rectifier and said ignition coil when said primary circuit opens to provide an ignition spark, storage capacitor means for aiding said transformer in charging said discharge capacitor, means for charging said storage capacitor when said primary circuit opens, said switch means comprising means controlled by said induced voltage pulses for closing and opening said primary circuit for causing current to flow and stop flowing in said primary circuit, and including a first transistor switch means for closing said primary circuit during said positive excursions of said pulses for allowing current from said battery to flow through said primary winding of said transformer, the trigger path of said transistor switch consisting of at least a diode directly connected to said transistor in the base-emitter circuit thereof, said at least a diode having a short circuit voltage of a first predetermined amplitude level and means for closing said transistor switch means when said positive part of said pulse rises above said first amplitude level and for opening said transistor switch means when said positive part of said pulse falls below said first amplitude level, said at least a diode being effective to block the negative part of said pulses from said transistor switch means.

2. The system of claim 1 wherein said switch means further includes, second and third transistors, the collector of said first transistor being connected through a resistor to the base of said second transistor and the emitter of said second transistor being connected to the base of said third transistor, the emitter of said third transistor being connected to one side of a primary winding of said transformer, the emitter of said first transistor and the collectors of said second and third transistors being connected in common, said third transistor being a power transistor, and means for inputting said distributor pulse to the base of said first transistor.

3. The system of claim 2 wherein the base of said second transistor is connected through at least a resistor to the emitter of said third transistor.

4. The system of claim 2 further including means for connecting at least a portion of the voltage outputted by said battery to said emitter and collectors connected in common only during engine start.

5. The system of claim 2 wherein said means for applying the voltage induced across said secondary winding of said transformer includes means for triggering said silicon controlled rectifier, said means for triggering including an essentially capacitive trigger path between said secondary winding and the gate-cathode junction of said silicon controlled rectifier.

6. The system of claim 2 wherein said discharge capacitor is effectively connected across the anode and gate of said silicon controlled rectifier.

7. A capacitive discharge ignition system comprising, a step-up transformer having a primary winding and a secondary winding, a primary circuit comprising said primary winding, a battery and a switch means, said switch means comprising means for closing and opening said primary circuit for causing current to flow and stop flowing in said primary winding, a discharge capacitor, a silicon controlled rectifier and an ignition coil being connected in circuit relationship with each other, with said discharge capacitor, and with the secondary winding of said transformer, means for applying the voltage induced across said secondary winding of said transformer when said primary circuit closes to said discharge capacitor to charge it, storage capacitor means for aiding said transformer in charging said discharge capacitor, means for charging said storage capacitor when said primary circuit opens, means for triggering said silicon controlled rectifier, when said primary circuit opens, means for discharging said discharge capacitor through said silicon controlled rectifier and said ignition coil when said silicon controlled rectifier is triggered to provide an ignition spark, said means for triggering including a trigger capacitor and a diode, said diode being connected between the cathode of said silicon controlled rectifier and one side of said trigger capacitor, the other side of said trigger capacitor being connected to one side of said secondary winding of said transformer.

8. The system of claim 7 wherein said storage capacitor means comprises a capacitor which is connected between said secondary winding and the gate of said silicon controlled rectifier.

9. The system of claim 7 wherein said discharge capacitor is effectively connected across the anode and gate of said silicon controlled rectifier.

10. The system of claim 9 wherein a diode is connected between the cathode of said silicon controlled rectifier and one side of said discharge capacitor.

11. The system of claim 7 further including means for preventing multiple firings of said silicon controlled rectifier.

12. The system of claim 11 wherein said means for preventing multiple firings includes a capacitor and a diode connected in series circuit, said series circuit being connected across the cathode and anode of said silicon controlled rectifier.

13. The system of claim 11 wherein said series circuit also includes a resistor connected between said diode and said capacitor, further including a further resistor connected between the capacitor-resistor junction and the gate of said silicon controlled rectifier.

14. The system of claim 7 wherein said transformer has an unequally split secondary winding.

* * * * *